US008801047B2

(12) United States Patent
Phillips et al.

(10) Patent No.: US 8,801,047 B2
(45) Date of Patent: Aug. 12, 2014

(54) STRENGTHENED INLET/OUTLET SWIVEL UNION FLUID CONDUIT FOR A HOSE REEL

(75) Inventors: William J. Phillips, Batavia, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 163 days.

(21) Appl. No.: 13/024,956

(22) Filed: Feb. 10, 2011

(65) Prior Publication Data

US 2012/0204972 A1 Aug. 16, 2012

(51) Int. Cl.
*F16L 37/00* (2006.01)

(52) U.S. Cl.
USPC ..... 285/305; 137/355.27; 137/355.26

(58) Field of Classification Search
USPC ..... 137/355.21–355.23, 355.26, 355.27; 285/305, 319, 321
See application file for complete search history.

(56) References Cited

U.S. PATENT DOCUMENTS

| | | | | |
|---|---|---|---|---|
| 4,506,698 | A * | 3/1985 | Garcia et al. | 137/355.26 |
| 4,512,361 | A | 4/1985 | Tisbo et al. | |
| 4,946,204 | A * | 8/1990 | Boticki | 285/281 |
| 5,046,520 | A | 9/1991 | Sanchez, Jr. et al. | |
| 5,259,410 | A * | 11/1993 | Trueb et al. | 137/375 |
| 5,676,402 | A | 10/1997 | Eley et al. | |
| 5,797,424 | A | 8/1998 | Tisbo et al. | |
| 6,637,454 | B1 | 10/2003 | Eley | |
| 7,377,289 | B1 | 5/2008 | English et al. | |
| 7,387,318 | B2 * | 6/2008 | Yoshida | 285/321 |
| 7,389,790 | B1 | 6/2008 | Eley et al. | |
| 7,464,970 | B2 * | 12/2008 | Yamada et al. | 285/305 |
| 7,568,735 | B2 * | 8/2009 | Akiba | 285/179 |
| 7,775,562 | B2 * | 8/2010 | Sawada | 285/406 |
| 2009/0121067 | A1 | 5/2009 | Arcati et al. | |
| 2011/0180158 | A1 * | 7/2011 | Arcati | 137/355.26 |

* cited by examiner

*Primary Examiner* — Aaron Dunwoody
(74) *Attorney, Agent, or Firm* — McHale & Slavin, P.A.

(57) ABSTRACT

The instant invention describes an improved inlet/outlet fluid conduit assembly having an inlet and outlet conduit for providing transportation of a fluid from a fluid supply source, i.e. a water spigot, to a fluid dispensing source, such as a hose. The inlet/outlet fluid conduit assembly uses a minimal number of interconnecting parts, thereby reducing the need for continued maintenance. When maintenance is required, the improved inlet/outlet fluid conduit assembly is quickly and easily disassembled to provide quick replacement of worn parts. In addition, the improved inlet/outlet fluid conduit assembly is constructed in such a manner that wear and tear of the outlet conduit resulting from long-term use is minimized.

12 Claims, 12 Drawing Sheets

STRENGTHENED INLET/OUTLET SWIVEL UNION FLUID CONDUIT FOR A HOSE REEL

FIELD OF THE INVENTION

The instant invention relates to an inlet/outlet assembly for transporting fluids from a fluid source to a remote location; and more particularly, to an inlet/outlet swivel union fluid conduit for use with a hose reel.

BACKGROUND OF THE INVENTION

Garden hoses are a necessity for homeowners and the like for lawn and garden care, as well as general all-around home care. Typically, hoses are found either wound and left on the ground near a water spigot, or wound on one of many known hose reel-type storage devices. These devices include portable hose reel carts, stationary frames, and stationary hose reel hangers that can be mounted to a surface of a building, such as an outer wall of a house. A typical portable hose reel cart, or frame, includes a rotatable reel or spool in which a hose is wrapped around, positioned between a pair of side frames. The hose reel cart may further contain a pair of hubs which are coupled to the housing structure. Common hose reel assemblies may also contain a crank for rotating the reel or spool such that the hose can be wound or unwound about the spool. To provide for flow of water from a water source to the hose, hose reel structures further contain water conduits. Typical water conduits have a movable outlet tube and a generally stationary inlet tube. The stationary inlet of the conduit extends away from the reel and is structured to be coupled to a supply hose which is further coupled to a water supply. The movable outlet of the conduit is disposed on the circumference of the reel. An outlet hose is coupled to the movable outlet and is used to deliver water to the end use. The hose is merely wound upon the reel for storage, and pulled or dispensed from the reel for use. These carts include wheels to permit ready transport of the hose from one location to another.

Hose carts are commonly purchased by the general consumer, wherein it is desirable that the hose cart can be easily assembled with minimal use of hand tools. In an effort to provide easy-to-assemble hose reel assemblies, they are typically made of plastic and sold with as many preassembled parts as possible. While such efforts have provided the general consumer with a product that is ready to use out of the box, disassembly for maintenance or repair can be difficult for some consumers. For example, in some prior art devices, it is difficult to have difficulty in secure the reel hub which is necessary for the introduction of water. The reel hub must allow rotation yet allow the device to be hooked up to a water supply wherein the hose can be reeled inward or outward without interfering with the flow of water. Seals within the hub allow rotation without leakage. The problem occurs when the seal requires service, either in the form of lubrication or replacement. In addition, the water conduit, such as inlet and outlet devices, often needs lubrication or replacement. Sealing devices, such as O-rings, are often used to prevent fluid leakage. Long-term use or storage of the hose reel assemblies in changing climates requires maintenance to ensure that the hose reel works properly. Typical hose reels require the consumer to disassemble the inlet/outlet assembly in order to replace worn sealing devices or the inlet/outlet conduits themselves. As such, maintenance procedures that are difficult or require extended amounts of time result in the consumer failing to properly maintain the hose reel assemblies. Failure to properly maintain the devices results in further deterioration and eventual failure.

Therefore, what is needed in the art is an improved inlet/outlet fluid conduit which can be maintained without the need for costly tools and time consuming replacement procedures.

DESCRIPTION OF THE PRIOR ART

Various hose reel assemblies are known in the art. For example, U.S. Pat. Nos. 4,512,361 and 5,046,520 set forth hose cart storage apparatuses which consist of various preassembled components that are easily assembled upon receipt by the average consumer. U.S. Pat. No. 5,797,424 describes a hose cart having improved hub connections. The hose reel includes a syringe type hub attachment which allows for maintenance of water seals without tools. In addition, the hub design allows for the placement of a crank for rotation of the hose reel flange in either a left hand or right hand position with the water coupling portion exchangeable by quick release of the syringe type hub attachment.

Vital to any hose reel assembly is the ability to transfer water from a water source to a hose typically wound around a spool. Such transfer of water is usually conducted by fluid conduits. U.S. Patent Publication 2009/0121067 describes a hose reel assembly having inlet/outlet conduit assemblies. The hose reel assembly includes an inlet conduit which is inserted within an outlet conduit. The inlet conduit includes a generally cylindrical body having a retaining clip groove extending at least partially circumferentially about the inlet body. A clip assembly is also included which engages the inlet conduit without the use of tools. The clip assembly includes an elongated body having a first end, a pivot point, a clip structure, and a second end. The clip assembly body is pivotally coupled to the hose reel assembly frame adjacent to a basket assembly conduit inlet end and structured to pivot in a plane of motion.

U.S. Pat. No. 7,377,289 describes a hose reel assembly having a folding crank handle, an easily accessible and identifiable release, a water system, and an autotrack device that can be engaged/disengaged. The water system includes an inlet member, a rotating outlet member, and an interlocking device structured to couple the inlet and outlet members. The inlet is described as being coupled to the hose reel assembly housing structure and having a generally circular body extending into the reel. The outlet member is coupled to the reel and has a wide diameter body extending into the reel. Accordingly, the inlet member is designed to extend into the outlet body. An O-ring is disposed at the interface between the inlet and outlet members to resist water leaking. The interlock structure is releasably coupled to the inlet and outlet members and includes one or more grooves in the outer surface of the inlet member, and at least one opening in the outlet body.

U.S. Pat. No. 7,389,790 discloses a reel assembly having a hub and opposing flanges that may be disassembled into at least two primary components that may be at least partially nested with one another for compact storage and transport. The reel assembly further includes a pair of opposing flanges projecting radially outwardly from opposite end portions of the hub to form an annular channel for receiving a length of the hose. The reel assembly further includes an axle having first and second end portions. The axle is coaxial with the hub and operatively coupled with the hub in a manner that permits selective rotation of the hub about the axle. A swivel connector is operatively coupled to a hose adjacent the second end portion of the axle and a swivel cap is disposed around one end portion of the swivel connector. The swivel cap is releasably coupled with the second end portion of the axle and has at least one locking tab that is shaped and sized to be releasably received by the second end portion of the axle.

U.S. Pat. No. 6,637,454 discloses a fluid handling system having a swivel for connecting a stationary fluid source line to a fluid service line that is wound upon a reel. The system includes a reel, an axle, a fluid source line, and a swivel connector. The system requires a rotor cap having at least one locking pin for preventing the movement of the rotor cap with respect to an axle. The rotor cap secures the fluid source line and a rotor within the swivel in position, allowing a housing within the swivel to freely rotate with the fluid service line and reel. The swivel is coupled to the fluid source line using a crimping ferrule to eliminate the necessity of predisposing mating components on the fluid source line.

U.S. Pat. No. 5,676,402 discloses a rotary union assembly having a rotor with an elongated central shaft with forward and rearward ends, an aperture extending forwardly through the shaft from the shaft rearward end to an aperture forward end spaced rearwardly from the shaft forward end and a port. The assembly further includes a rotor housing rotatably mounted on the rotor forward end for rotation about the longitudinal axis of the shaft. The housing contains a radially projecting arm having a radially extending port. A central flange projects radially from the shaft rearwardly of the housing. The assembly has a means operably mounted on the central shaft, rearwardly of the central flange, for releasably securing the rotor to a tubular support member, and is removably connected to the central shaft forwardly of the housing, for releasably securing the housing on the shaft while permitting rotatable movement of the housing.

SUMMARY OF THE INVENTION

The instant invention describes an improved inlet/outlet fluid conduit assembly having an inlet and outlet conduit for providing transportation of a fluid from a fluid supply source, i.e. a water spigot, to a fluid dispensing source, such as a hose. The inlet/outlet fluid conduit assembly uses minimal number of interconnecting parts, thereby reducing the need for continued maintenance. When maintenance is required, the improved inlet/outlet fluid conduit assembly is quickly and easily disassembled to provide quick replacement of worn parts. In addition, the improved inlet/outlet fluid conduit assembly is constructed in such a manner that wear and tear of the outlet conduit resulting from long-term use is minimized.

In an illustrative, albeit preferred embodiment, the inlet/outlet fluid conduit assembly for transporting a fluid from a first position to a second position comprises an inlet conduit, and outlet conduit. The inlet fluid conduit has a generally cylindrically shaped inlet conduit main body having a first end adapted for attachment to a water source and a second end adapted for coupling to an outlet conduit. The second end has an inner diameter that is larger than the outer diameter of an outlet conduit. A flange is arranged about the circumference of the inlet main body conduit and has a front surface, a back surface, a portion thereof adapted for receiving a securing member, and a tab extending outwardly from said back surface for engaging the wall or frame of a hose reel assembly to prevent said circular member from rotating.

The outlet conduit has a generally cylindrically shaped horizontal outlet conduit body which is sized to extend through a central portion of a hose reel spool. The horizontal outlet conduit body has a first end having an outer diameter that is smaller than the inner diameter of the second end of the inlet conduit, and a second end defined by a vertical outlet conduit body having an L-shaped portion for extending through the side portion of a hose spool. The L-shaped portion has at least one end adapted for attachment to a fluid dispensing device, such as a hose. Insertion of the inlet device within the inlet device forms an inlet/outlet assembly which provides fluid passageway from said fluid source to said fluid dispensing device. In this configuration, damage (formation of internal grooves as a result of rotation) to the outlet device is minimized.

The inlet/outlet fluid conduit assembly may further include including a securing member for securing the inlet/outlet fluid conduit assembly. The securing member being a generally C-shaped clip defined by a first end, a second end, and two generally parallel arms extending from the first end. Each of the arms contains engaging members for engaging the inlet and outlet conduit. For example, engaging members engage the inlet conduit at one or more slotted openings adapted for receiving the securing member engaging members. The outlet member contains a recessed channel which is adapted for receiving the securing member engaging members, whereby insertion of the engagement members within the recessed channel allows rotation of the outlet device conduit while the inlet device remains fixed in position.

Accordingly, it is an objective of the instant invention to provide an improved inlet/outlet fluid conduit assembly.

It is a further objective of the instant invention to provide an improved inlet/outlet fluid conduit assembly that is easily assembled and disassembled.

It is yet another objective of the instant invention to provide an improved inlet/outlet fluid conduit assembly having increased strength and durability.

It is a further objective of the instant invention to provide an improved inlet/outlet fluid conduit assembly utilizing a minimal number of parts.

It is a still further objective of the invention to provide an improved inlet/outlet fluid conduit assembly having an outlet conduit insertable within an inlet conduit, and a clip member.

It is yet another object of the instant invention to provide for an improved inlet/outlet fluid conduit assembly in which damage to the outlet conduit resulting from continued use is minimal.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
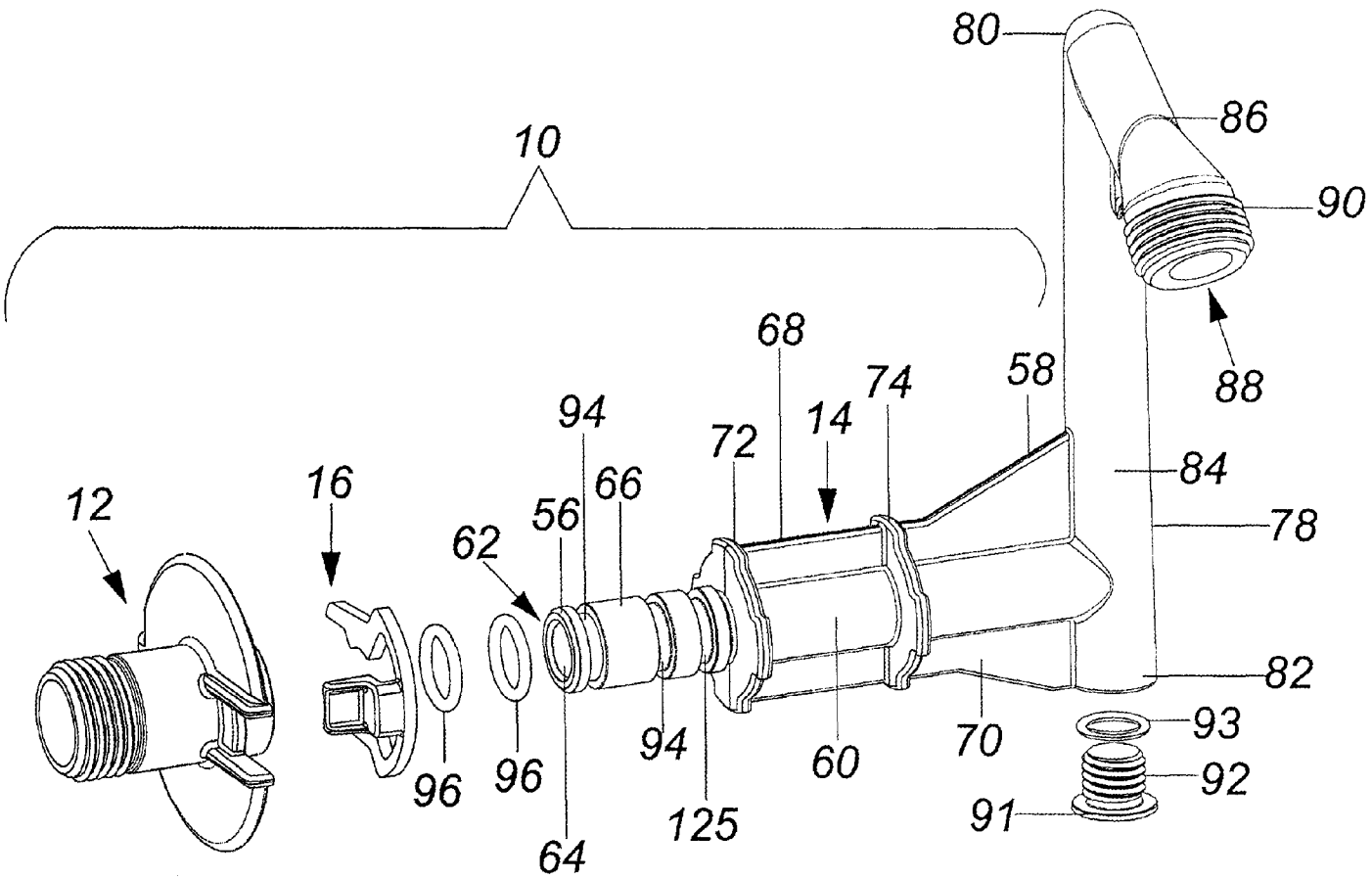
FIG. 1 is an exploded view of the inlet/outlet swivel union fluid conduit assembly in accordance with the instant invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIG. 1, an inlet/outlet swivel union fluid conduit assembly, generally referred to as 10, is illustrated. While the inlet/outlet swivel union fluid conduit assembly can be made of any material, such as various types of plastic, it is preferably made of die-casted metal, such as, but not limited to, aluminum or zinc, which provides the necessary strength, durability, and precision needed to perform its functions. The die-cast aluminum further provides stronger engagement with mating hose couplings, and further allows for secondary operations on mating and O-ring sealing surfaces which better hold surface finish conditions, eliminate draft and hold tolerances needed for consistent and improved fluid sealing. The inlet/outlet swivel union fluid conduit assembly 10 may be used for various applications that require transfer of fluids from one place to another. A common application of the assembly 10 includes being part of a hose reel assembly. Accordingly, the instant invention will be described using such an application. However, placement or use in hose reel assemblies is not a limiting application as the assembly 10 can be placed in other devices as well.

Figure 3:
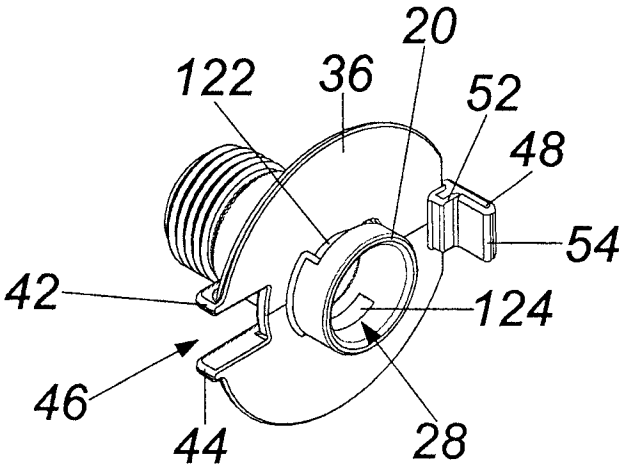
FIG. 3 is a back perspective view of the inlet conduit in accordance with the instant invention.
Figure 2:
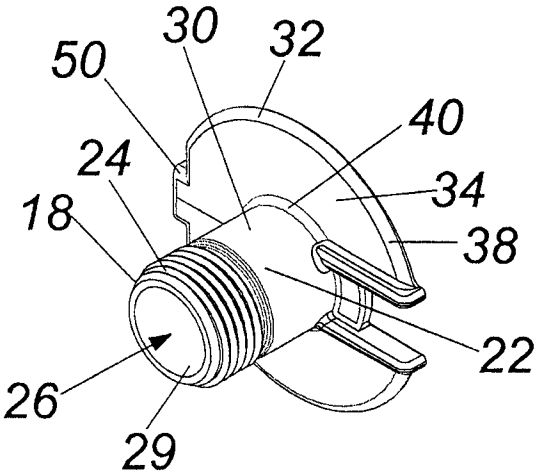
FIG. 2 is a front perspective view of the inlet conduit in accordance with the instant invention.

Referring to FIG. 1, the inlet/outlet swivel union fluid conduit assembly 10 includes an inlet conduit 12, an outlet conduit 14, and a securing member 16. The inlet conduit 12 includes a first end 18 and a second end 20, see FIGS. 2 and 3. The distance between the first end 18 and the second end 20 defines the inlet conduit main body 22. In the preferred embodiment, the inlet conduit main body 22 is generally cylindrical in shape. The inlet conduit main body 22 has an inner diameter which is larger than the outer diameter of the outlet conduit 14. The first end 18 is designed to be coupled or attached to an external fluid supply, such as a hose connected to water supply line (not illustrated). As such, the first end 18 contains threading 24 or other hose connectors. The first end 18 further includes an opening 26. The second end 20 is constructed and arranged to couple or engage with a portion of the outlet conduit 14 and contains an opening 28. A generally smooth bore 29 extends between the first end 18 and the second end 20.

Arranged circumferentially around the outer surface 30 of the inlet conduit main body 22 is a flange 32. The flange 32 is illustrated as having a generally circular shape. However, such shape is illustrative of a particular embodiment and such shape is not limiting. The flange 32 contains a front surface 34, a back surface 36, an outer edge 38 and an inner edge 40. Positioned along the circumference of the flange 32 and extending inwardly toward the center are horizontal edges 42 and 44. Between horizontal edges 42 and 44 is an open space 46. The open space 46 is sized and shaped to receive a portion of the securing member 16. Opposing the horizontal edges 42 and 44 is tab 48 which secures to or engages the wall or frame of a hose reel assembly to prevent the flange and/or the inlet conduit 12 from rotating. The tab 48 contains a rounded front portion 50, a rectangular portion 52 directly coupled to the back surface 36 of the flange 32, and a second generally rectangular member 54 which extends in an outward direction from the back surface 36.

Referring back to FIG. 1, the outlet conduit 14 includes a first end 56 and a second end 58. The distance between the first end and the second end defines a generally cylindrically shaped horizontal outlet conduit body 60. The horizontal outlet conduit body 60 is shaped to extend through the central portion of a hose spool. Accordingly, the length can be varied depending on the length of the hose spool. The outlet conduit first end 56 contains opening 62. The horizontal outlet conduit body 60 has an outer diameter which is smaller than the internal diameter of the inlet conduit 12. A first outlet conduit bore 64, see FIG. 4, extends the length of the horizontal outlet conduit body 60. The bore 64 may be uniformly shaped from end to end, or alternatively may contain tapering. The first end 56 is sized and shaped to couple or engage the inlet conduit 12 through insertion within the second end 20 of the inlet conduit 12. Positioned along the outer surface 66 of the horizontal outlet conduit body 60 are gussets 68 and 70. A plurality of outwardly extending keyed flanges 72 and 74 are sized and shaped to provide support for, coupling to and/or engaging with the hose reel spool or the wall or frame of the hose reel assembly. The keyed flanges 72 and 74 prevent the hose reel spool from separating or moving as it rotates. Positioned at the second end 58 of the horizontal outlet conduit body 60 is a generally cylindrical vertical outlet conduit body 78.

The vertical outlet conduit body 78 includes a top end 80, a bottom end 82, and a vertical outlet conduit main body 84 extending there through. The interior of the vertical outlet conduit main body 84 contains a bore 85, see FIG. 4, which is sized and shaped in the same manner as the bore 64. The top portion 80 contains a traverse positioned L-shaped portion 86 terminating in opening 88. The opening 88 may define the second end of the outlet conduit 14. The L-shaped portion 86 is designed to be coupled or attached to a fluid dispensing device, such as an elongated hose member (not illustrated). As such, the L-shaped portion 86 contains threading 90 or other hose connectors. The bottom end 82 may be reversibly sealed, using for example, a plug 91 which may contain sealing members, such as threading 92 and an O-ring 93. Alternatively, the bottom end may be permanently sealed.

Figure 4:
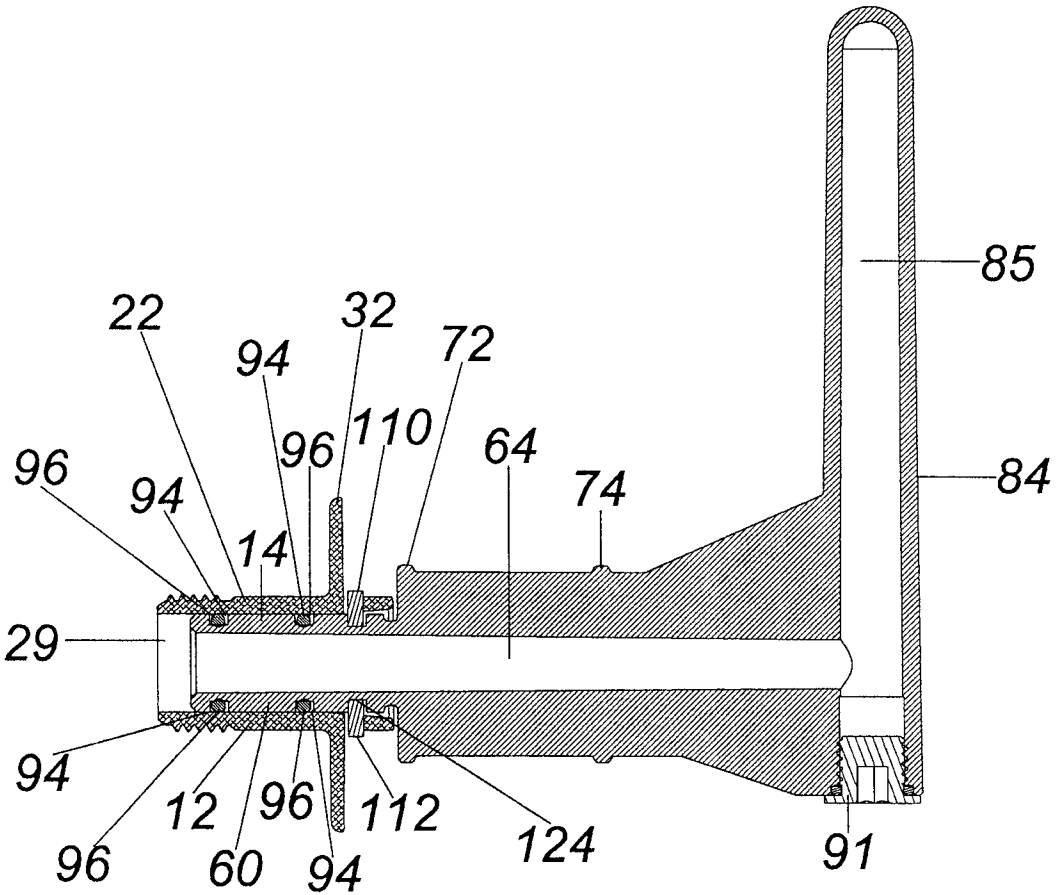
FIG. 4 is a cross section view of the inlet/outlet swivel union fluid conduit assembly in accordance with the instant invention.

FIG. 4 illustrates the inlet/outlet swivel union fluid conduit assembly 10 in an assembled state. Notably, a portion of the outlet conduit 14, which contains a smaller outer diameter than the inner diameter of the inlet conduit 12, is inserted into a portion of the inlet conduit 12. In the assembled state, the first end 56 of the horizontal outlet conduit body 60 is inserted into the opening 20 of the inlet conduit 12 and through the smooth bore 29, towards the first end 18 of the inlet conduit. In this manner, a fluid connection is made in which water entering from the opening 26 of the inlet conduit 12 can travel through the fluid passageway, formed by the insertion of the first end 56 of horizontal outlet conduit body 60, towards the opening 88 of the vertical outlet conduit body main body 84. A fluid passage is created, therefore, which allows fluid passage from the outside of the hose reel assembly to the hose wound on the spool. Referring back to FIG. 1, the horizontal outlet conduit body 60 may include one or more O-ring grooves 94, as well as one or more O-rings 96 structured to be partially or fully placed within the O-ring grooves 94. When the O-rings 96 are disposed within the O-ring grooves 94 and the horizontal outlet conduit body 60 is inserted within the inlet conduit 12, the O-rings 96 engage both the inlet member 12 and the horizontal outlet conduit body 60, preventing, or substantially minimizing fluid traveling through the gaps between the bore 29 of the inlet conduit 12 and the horizontal outlet conduit body 60.

Figure 7:
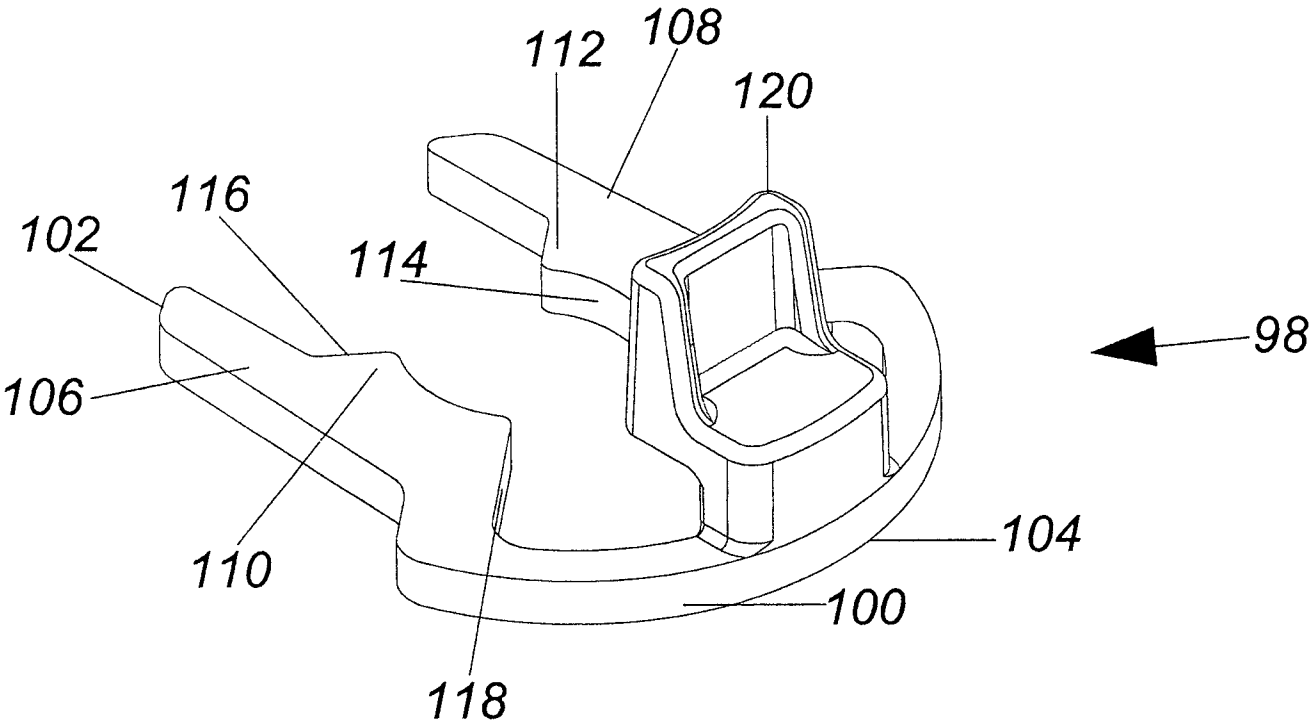
FIG. 7 is a perspective view of an illustrative embodiment of a clip member in accordance with the instant invention.

The inlet/outlet swivel union fluid conduit assembly 10 further includes a securing member, illustrated herein as a clip member 98, see FIG. 7, which is sized and shaped to engage portions of the inlet conduit 12 and the outlet conduit 14. The clip member 98 has a generally C-shaped body configuration having a first end 100 and a second end 102. The first end is defined by a generally rounded portion 104. Two substantially parallel arms 106 and 108 extend from the generally rounded portion 104. Each of the arms 106 and 108 contain an engaging member, 110 or 112. The engaging members 110 and 112 are sized and shaped to couple with at least a portion of the inlet conduit 12 and the outlet conduit 14. For example, the engaging members may contain a curved portion 114 which is sized and shaped to engage the horizontal outlet conduit body 60. Additionally, angled sides 116 or 118 may be sized and shaped for ease of insertion into and removal out of a portion of the inlet conduit 12.

Figure 5:
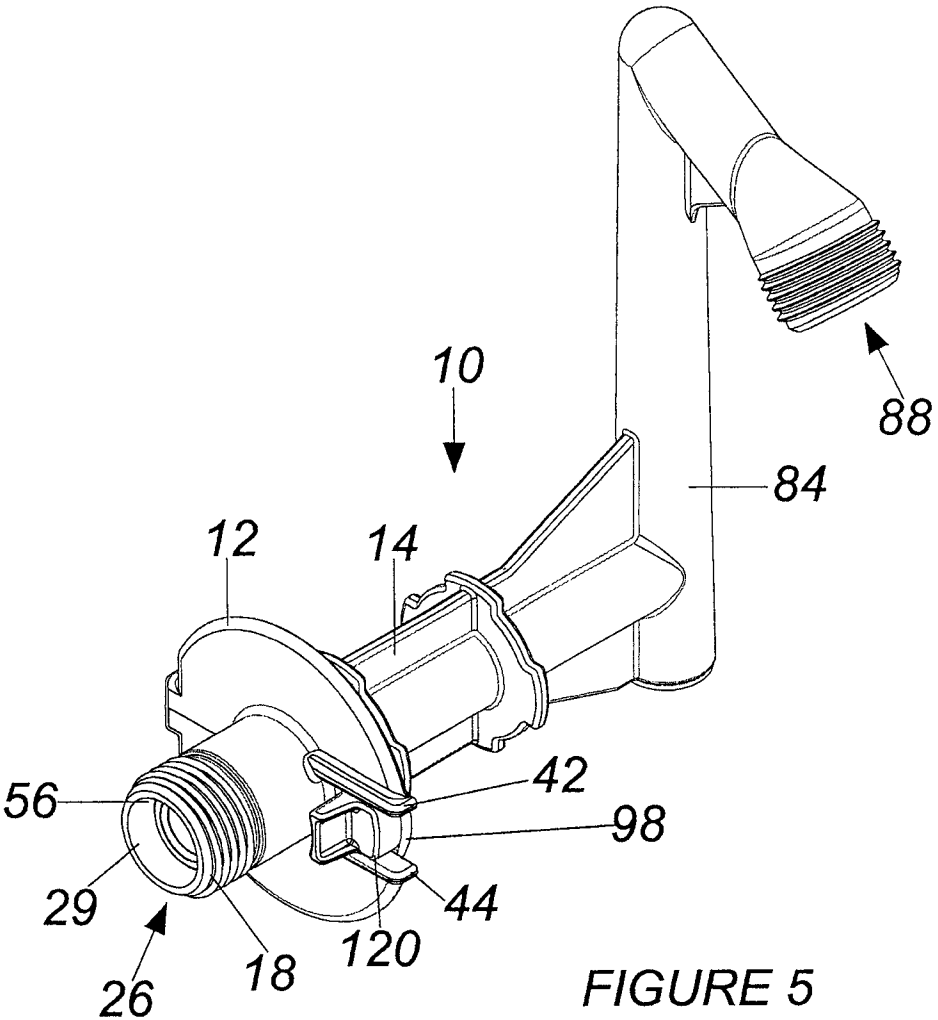
FIG. 5 is a side perspective view of the inlet/outlet swivel union fluid conduit assembly, in an unlocked position, in accordance with the instant invention.
Figure 6:
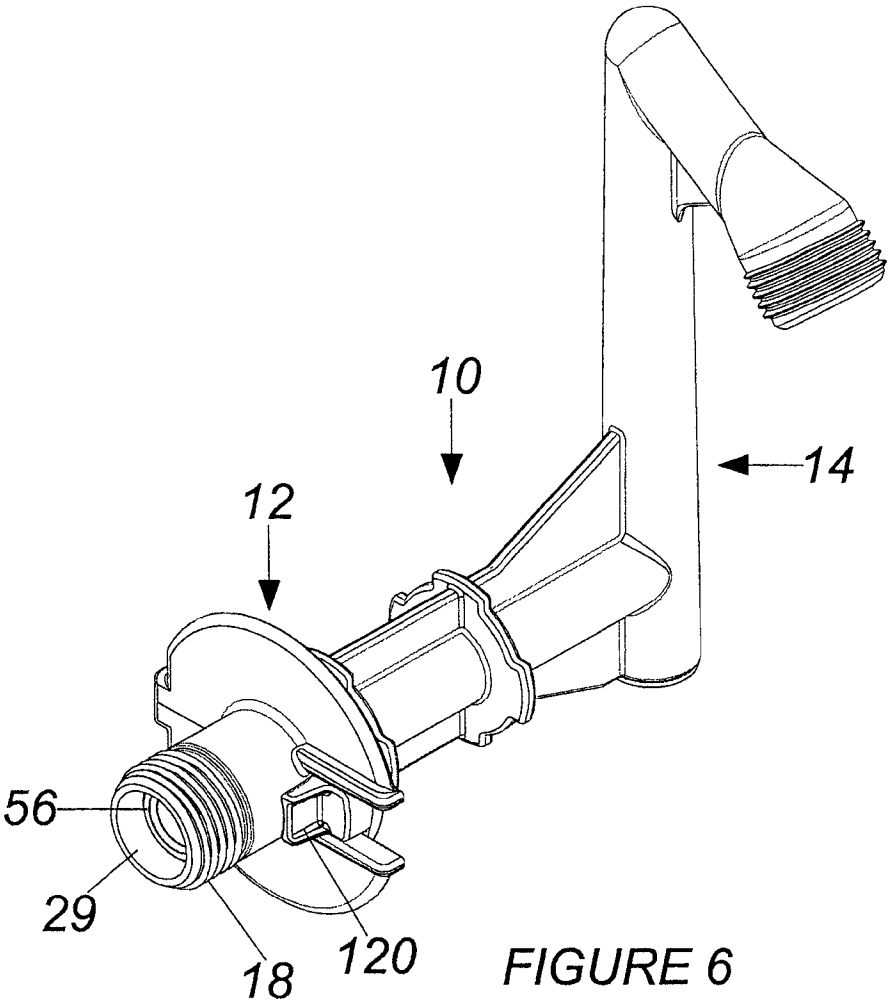
FIG. 6 is a side perspective view of the inlet/outlet swivel union fluid conduit assembly, in a locked position, in accordance with the instant invention.
Figure 8:
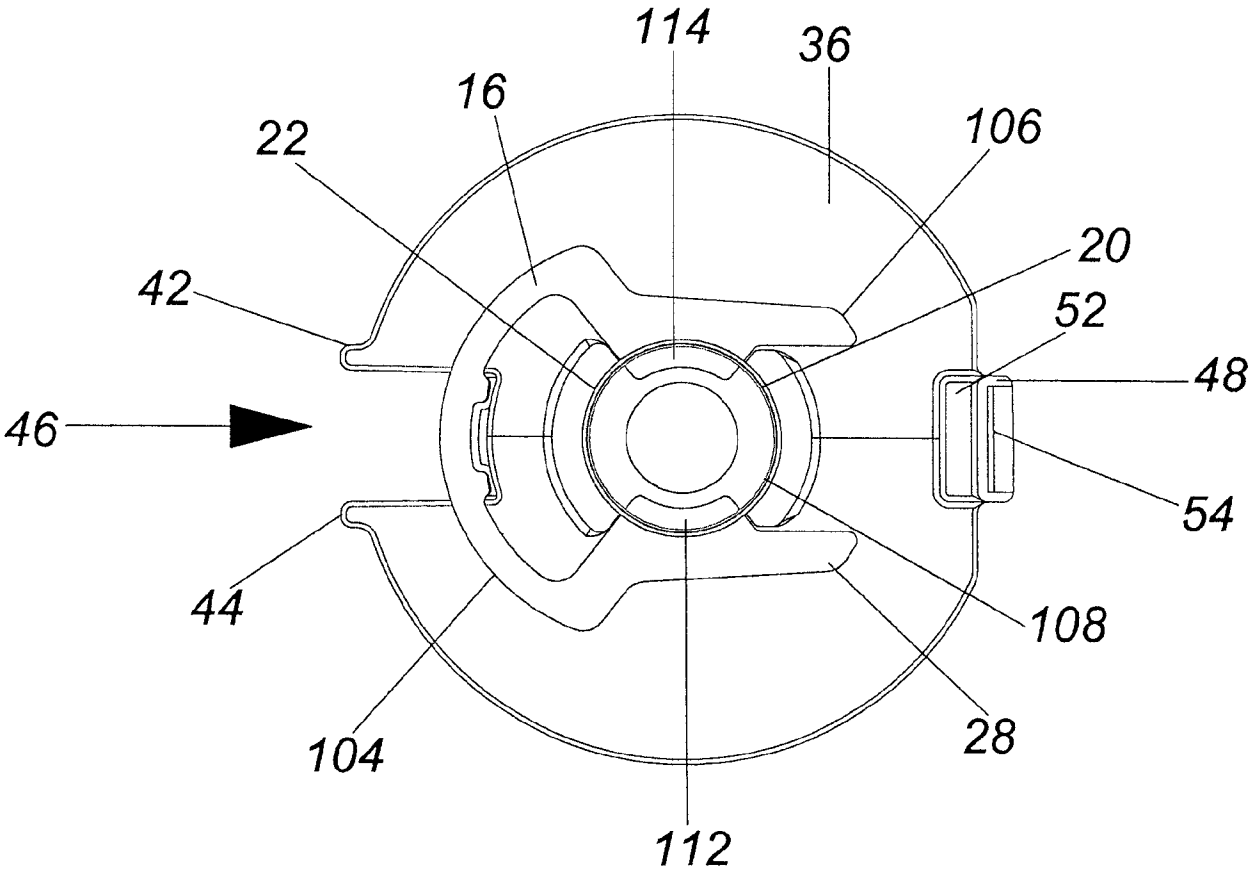
FIG. 8 is a back perspective view of the inlet conduit engaged with a clip member.

In a preferred embodiment, the clip member 98 is aligned with the back surface 36 of the flange 32 of the inlet conduit 12, see FIG. 8. FIG. 5 illustrates the clip member 98 in the unsecured position. In such a position, a tab 120 is positioned between horizontal edges 42 and 44 within open space 46. The arms 106 and 108 and the engaging members 110 and 112 rest at or near the inlet conduit main body 22. Referring to FIG. 6, the inlet/outlet swivel union fluid conduit assembly 10 is illustrated in the locked position. From the unlocked position illustrated in FIG. 5, a user engages the tab 120 by exerting a force inwardly, i.e. towards the inlet conduit main body 22. As the tab 120 is pushed in, the first end 100 and the arms 106 and 108 of the clip member 98 move toward the inlet conduit main body 22. The movement of the clip member 98 allows the engaging members 110 and 112 to engage the inlet conduit main body 22 through slotted openings 122 and 124 (see FIG. 3) sized and shaped to receive the engaging members 110 and 112, see FIG. 8. The engaging members 110 and 112 are also sized and shaped to engage a portion of the horizontal outlet conduit body 60 once inserted within the inlet conduit main body 22. Preferably, when inserted within the inlet conduit main body 22, a recessed channel 125, see FIG. 1, circumferentially arranged about the horizontal outlet conduit body 60 aligns with the slotted openings 122 and 124. The curved surfaces 114 and 116 are positioned within the recessed channel 125, allowing the outlet conduit 14 rotational movement while the inlet conduit 12 remains fixed. To unlock the clip, the user simply exerts a force in the opposite direction, i.e. away from the inlet conduit main body 22. Once in the unlocked position, the inlet conduit 12 can easily be removed from the inlet/outlet swivel union fluid conduit assembly 10 for maintenance or replacement.

Figure 9:
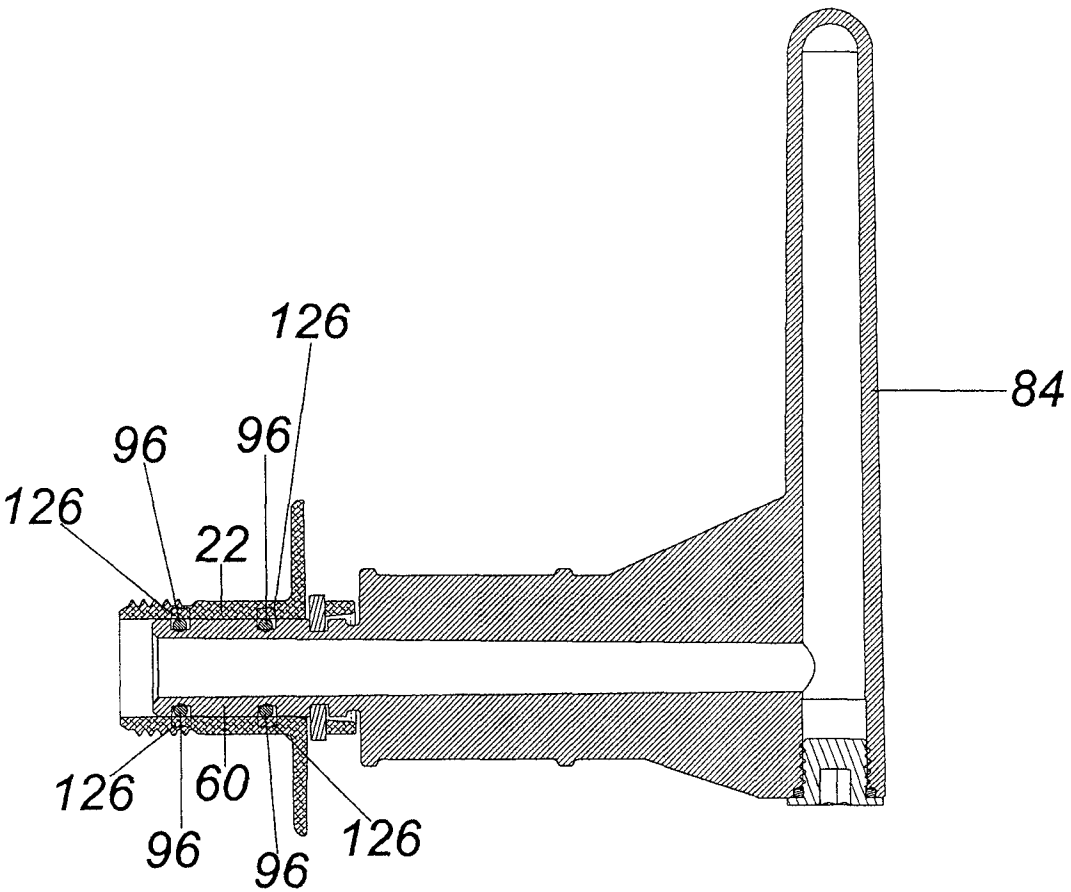
FIG. 9 is a cross section view of the inlet/outlet swivel union fluid conduit assembly in accordance with the instant invention, illustrating the creation of internal grooves as a result of long term usage.
Figure 10:
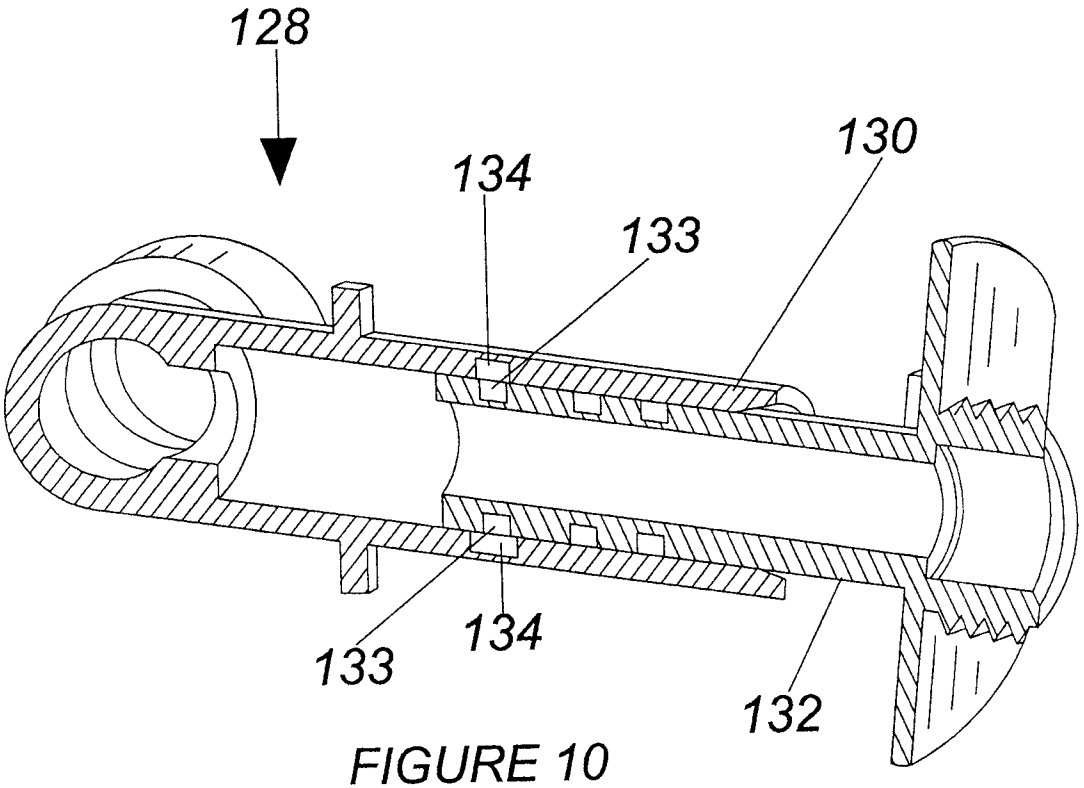
FIG. 10 is a cross section view of a prior art fluid conduit assembly, illustrating the creation of internal grooves as a result of long term usage.

When used with a hose reel assembly, the inlet/outlet swivel union fluid conduit assembly 10 is designed such that the back surface 36 of the flange 32 of inlet conduit 12 can be coupled to the frame or the hose reel assembly structure (not illustrated). The first end 18 of the inlet conduit main body 22 rests outside of the hose reel assembly structure. The outlet conduit 14 extends within the central portion of the hose reel spool and through a portion of the spool for attachment of a hose member (not illustrated). In this configuration, the inlet conduit 12 remains fixed in position while the outlet conduit 14 rotates. As described previously, in order to minimize fluid flow between the inlet conduit 12 and the outlet conduit 14, the outlet conduit contains one or more O-rings. One of the problems associated with constant rotation of the outlet conduit is the wear on the O-rings and the formation of internal grooves 126 formed within the bore 29 as the O-rings press against the rotating surface of the bore 29, see FIG. 9. Because the outer diameter of the outlet conduit 14 is smaller than the inner diameter of the inlet conduit 12, thereby allowing the outlet conduit 14 to be inserted within the inlet conduit 12, the formation of the internal grooves 126 occurs within the inlet conduit 12. In contrast to prior art fluid conduits 128, see FIG. 10, where the outlet conduit 130 has a larger inner diameter than the outer diameter of the inlet conduit 132, thereby allowing the inlet conduit 132 to be inserted within the outlet conduit 130, formation of internal grooves 134 (as a result of contact with O-rings 133) is formed within the outlet conduit 130. Since formation of internal grooves provides opportunity for fluid leaking, the instant invention provides the user the ability to quickly and easily maintain the inlet/outlet swivel union fluid conduit assembly not accomplished by other prior arts conduits. Since the internal grooves are formed within the inlet conduit, the user simply detaches the conduit and replaces it with a new conduit. In order to fix the prior art assemblies illustrated in FIG. 10, the user would have to replace the outlet conduit, which, as a result of it extending through the spool, is costly, time consuming and difficult.

Figure 11:
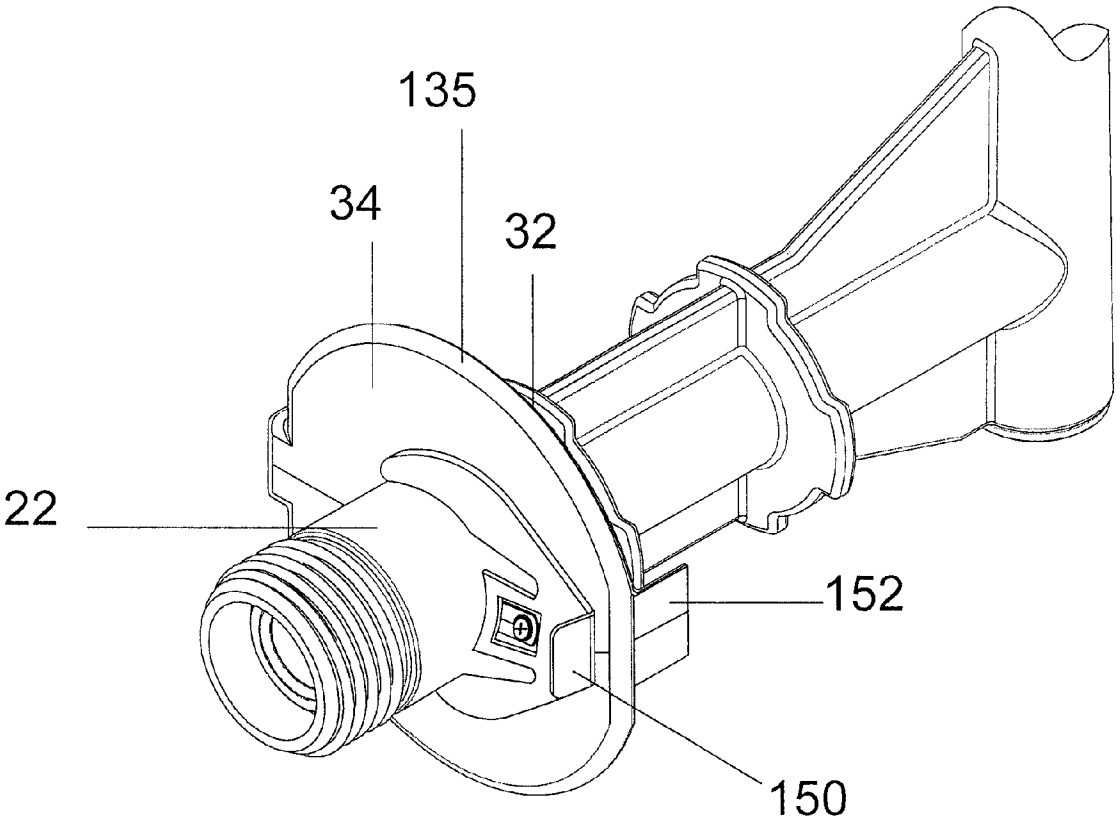
FIG. 11 is a perspective view of an alternative embodiment of the inlet/outlet swivel union fluid conduit assembly, in an unlocked position, in accordance with the instant invention.
Figure 12:
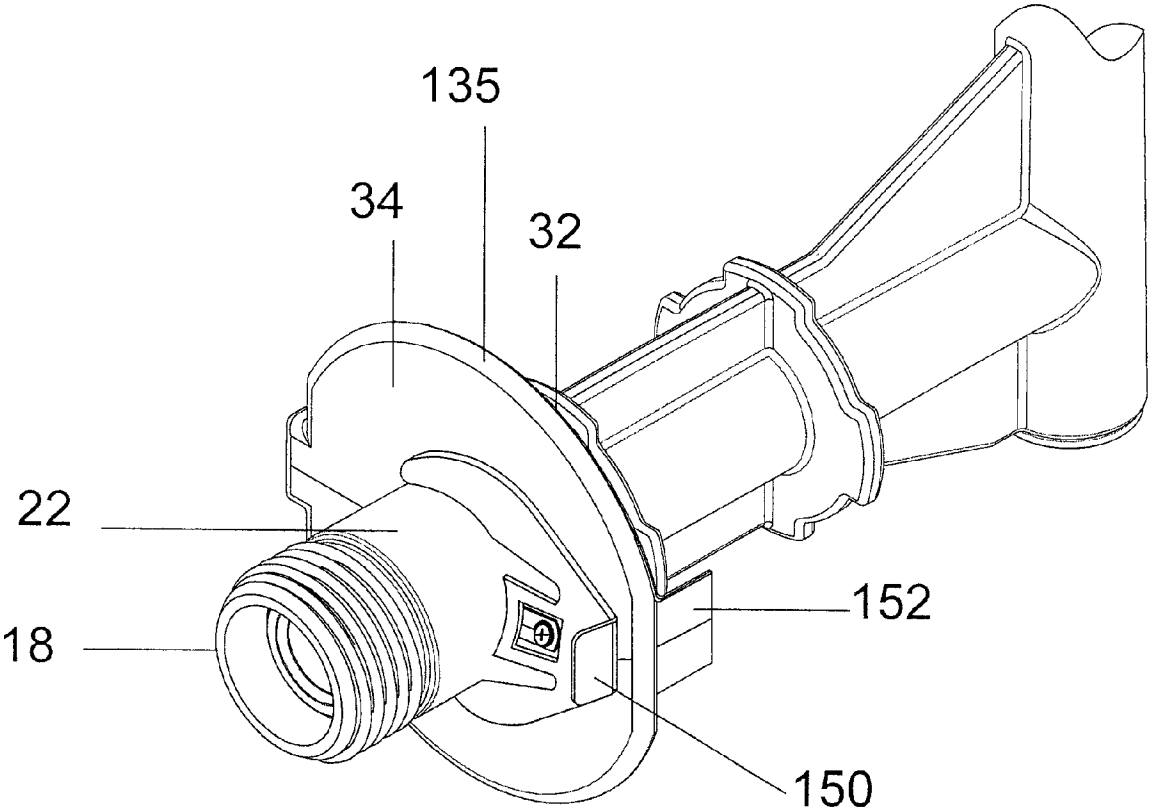
FIG. 12 is a perspective view of an alternative embodiment of the inlet/outlet swivel union fluid conduit assembly, in a locked position, in accordance with the instant invention.
Figure 13:
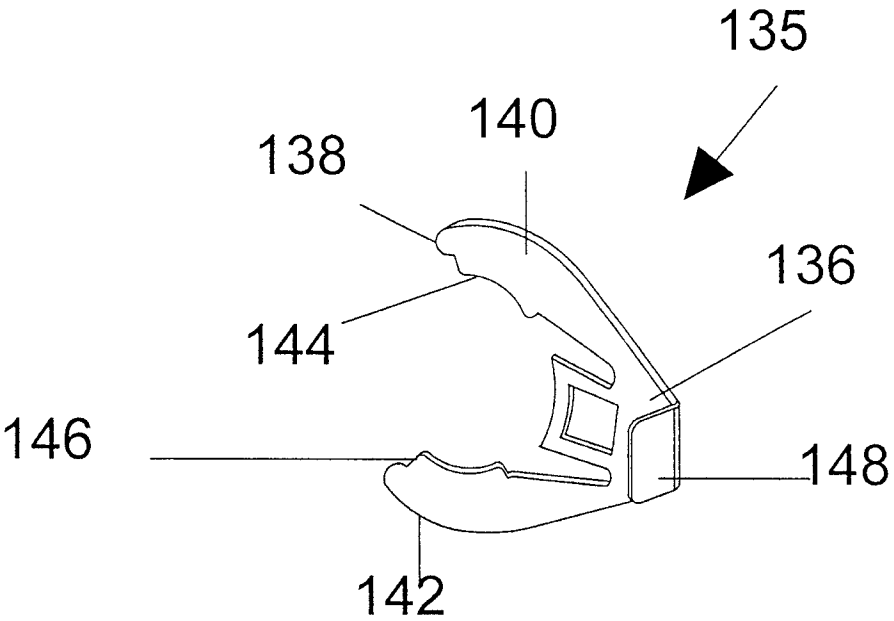
FIG. 13 is a perspective view of an alternative embodiment of a clip member in accordance with the instant invention.

Referring to FIGS. 11-13, an alternative embodiment of the inlet/outlet swivel union fluid conduit assembly 10, in which the clip member 135 is positioned along the front surface 34 of the flange 32 is illustrated. The locking member in accordance with the illustrated embodiment contains many of the same features, including a generally C-shaped body configuration having a first end 136 and a second end 138, see FIG. 13. Two substantially parallel arms 140 and 142 extend from the first end 136. Each of the arms 140 and 142 contain an engaging member, 144 and 146. Near the first end 136 is a locking structure which allows insertion of a securing hardware, such as a screw, to secure the clip member 135 to the flange 32. The engaging members 144 and 146 are sized and shaped to couple or engage with at least a portion of the inlet conduit 12 and the outlet conduit 14 in the same manner as described previously. Since the clip assembly 135 is positioned along the front surface 34 of the flange 32, the engaging members 144 and 146 are inserted into slotted openings located towards the first end 18 of the main body 22, see FIG. 11. To place the clip member 135 in the locking position, the user applies a force on tab 148 inwardly toward the main body 22, and tightens the securing device, illustrated herein as a screw 150 and washer 152, see FIG. 12, once the clip is in place.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An inlet/outlet fluid conduit assembly for transporting a fluid from a first position to a second position compromising: an inlet conduit, said inlet conduit including a generally cylindrically shaped inlet conduit main body having a first end with a first end opening adapted for attachment to a first fluid dispensing device coupled to a water source, a second end configured to couple to an outlet conduit and having a plurality of openings positioned about said inlet conduit main body to coaxially align with a recessed channel circumferentially arranged about a horizontal outlet conduit body when coupled thereto, said second end having an inner diameter that is larger than the outer diameter of an outlet conduit and having a second end opening, a flange arranged about the circumference of said inlet main body conduit and dividing said inlet main body into a first portion comprising said first end adapted for attachment to a first fluid dispensing device coupled to a water source comprising and a second portion said second end having an inner diameter that is larger than the outer diameter of an outlet conduit, said flange having a front surface, a back surface, a portion thereof adapted for receiving a securing member, and a tab extending outwardly from said back surface for engaging the wall or frame of a hose reel assembly to prevent said flange from rotating, said cylindrically shaped inlet conduit main body having a bore extending between said first end opening and said second end opening;

an outlet conduit, said outlet conduit having a generally cylindrically shaped horizontal outlet conduit body sized to extend through a central portion of a hose reel spool and having at least one recessed channel circumferentially arranged there about, said recessed channel sized and shaped to receive a securing member, said horizontal outlet conduit body having a first end which has an outer diameter that is smaller than the inner diameter of said second end of said inlet conduit, and a second end defined by a vertical outlet conduit body having an L-shaped portion for extending through the side portion of a hose spool, said L-shaped portion having at least one end adapted for attachment to a second fluid dispensing device; and a securing member for securing said inlet conduit with said outlet conduit; wherein insertion of said outlet device within said inlet device forms an inlet/outlet assembly which provides fluid passageway from a fluid source to a second fluid dispensing device.

2. The inlet/outlet fluid conduit assembly according to claim 1 wherein said securing member having a curved body having a first end, a second end, and two arms extending from said first end, each of said arms containing engaging members for engaging said inlet and outlet conduit.

3. The inlet/outlet fluid conduit assembly according to claim 2 wherein said plurality of openings include at least two slotted openings oppositely arranged about said inlet fluid conduit cylindrical body configured to receive said securing member engaging members, whereby insertion of said engagement members within said recessed channel allows rotation of said outlet device conduit while said inlet device remains fixed in position.

4. The inlet/outlet fluid conduit assembly according to claim 3 wherein said securing member includes a tab for traversing said securing member between a first unlocked position and a second locked position.

5. The inlet/outlet fluid conduit assembly according to claim 4 wherein said securing member is aligned with the back surface of said flange.

6. The inlet/outlet fluid conduit assembly according to claim 5 wherein said securing member is aligned with the front surface of said flange.

7. The inlet/outlet fluid conduit assembly according to claim 1 wherein said inlet conduit and said outlet conduit is constructed by die casting method.

8. The inlet/outlet fluid conduit assembly according to claim 1 wherein said inlet conduit and outlet conduit is made of.

9. The inlet/outlet fluid conduit assembly according to claim 1 wherein said inlet conduit and outlet conduit is made of zinc.

10. The inlet/outlet fluid conduit assembly according to claim 3 wherein said horizontal outlet conduit body further includes a plurality of outwardly extending keyed flanges sized and shaped to provide support for, coupling to, or engaging with a hose reel spool or portion of a hose reel assembly.

11. The inlet/outlet fluid conduit assembly according to claim 3 wherein said inlet conduit flange contains a channel adapted for receiving a portion of said securing member, said portion of said securing member slideably engaging said channel when traversed between said locked position and said unlocked position.

12. The inlet/outlet fluid conduit assembly according to claim 1 wherein said flange arranged about the circumference of said inlet main body conduit comprises two surface edges separated by a gap, said gap sized to allow at least a portion of a securing member to slideably move within said gap and between said two surface edges.

* * * * *